US005490305A

United States Patent [19]

Domingo Ribot

[11] Patent Number: 5,490,305

[45] Date of Patent: Feb. 13, 1996

[54] PERFECTED HINGE

[76] Inventor: Angel Domingo Ribot, Valles 42, Sta. Maria De Montcada, Spain, 08110

[21] Appl. No.: 213,631

[22] Filed: Mar. 16, 1994

[30] Foreign Application Priority Data

Mar. 16, 1993 [ES] Spain ..... 9300683 U

[51] Int. Cl.[6] ..... E05D 7/10

[52] U.S. Cl. ..... 16/229; 160/206

[58] Field of Search ..... 16/229, 380; 160/199, 160/206, 210, 213

[56] References Cited

U.S. PATENT DOCUMENTS

| | | | |
|---|---|---|---|
| 2,184,259 | 12/1939 | Seaman et al. | 20/16 |
| 2,365,378 | 12/1944 | Benson | 16/171 |
| 2,564,386 | 8/1951 | Webb | 16/DIG. 2 |
| 2,901,036 | 8/1959 | Greig | 160/206 |
| 3,117,827 | 1/1964 | Cecala et al. | 308/161 |
| 3,187,800 | 6/1965 | Kirby | 160/206 |
| 3,221,804 | 12/1965 | Rudnick | 160/206 |
| 3,511,300 | 5/1970 | Matyas | 160/206 |
| 3,514,805 | 6/1970 | Foltz | 160/206 |
| 4,620,392 | 11/1986 | Kerpers et al. | 16/229 |
| 4,799,529 | 1/1989 | McAfee | 160/201 |

FOREIGN PATENT DOCUMENTS

| | | |
|---|---|---|
| 2452567 | 10/1980 | France . |
| 2473603 | 7/1981 | France . |
| 3613574 | 12/1987 | Germany . |
| 8903041 | 8/1989 | Spain . |
| 9001888 | 5/1990 | Spain . |
| 672346 | 4/1987 | Switzerland . |
| 1284258 | 8/1972 | United Kingdom . |

*Primary Examiner*—P. Austin Bradley
*Assistant Examiner*—Chuck Y. Mah
*Attorney, Agent, or Firm*—Jacobson, Price, Holman & Stern

[57] ABSTRACT

A hinge structure for a door has a sprung stub at the top of the door which fits into a cavity in an overhead lintel. At the bottom the door has a plate with an aperture to fit on a support post on a support bracket. The support bracket has a vertical limb attached to a vertical door jamb and a horizontal limb with the post which rests on the floor. The door has a part circular vertical edge portion about which it is hinged. The sprung stub can be depressed by a rod inserted in an aperture in the door.

5 Claims, 2 Drawing Sheets

PERFECTED HINGE

BACKGROUND OF THE INVENTION

The present Invention concerns a hinge structure, as indicated in its wording, whose new construction, conformation and design features fulfil the aim for which they have been specifically designed, with maximum safety and efficiency.

There are a set of hinges available on the market which we could call accident-proof and which can therefore be considered state-of-the-art. These prevent their application to door frames, window frames and the like from causing any kind of undesired effect through fingers becoming trapped between the jamb from which the door hangs and the door itself.

The same applicant, at a given time, requested Utility Models no. 8903041(9) and no. 9001889(5), which in the first of them claimed a hinge formed by an open circular longitudinal section, split at one length, thus allowing the door, window or similar, which had to open or close, to be placed inside it. This circular section was slotted inside another section, which was also slightly circular and long, which was secured to the frame.

The second section was formed by two parts or half-sections, which were secured by the corresponding screws, thus making the first inside section easy to mount, as this second section was formed by two complementary pieces greater in diameter than the first.

The second Utility Model no. 9001888(5) was a perfected version of the first, in the sense that it introduced a set of accessories to the hinge which is the object of Utility Model no. 8903041(9) in order to fix it to the frame, so that the task of attaching the door to the frame, removing it, or closing it was made easier, these accessories were supports which were mounted both on the upper part of the closing frame, as well as on the lower part of the hinge which was fixed onto it.

The placing on the market of the objects of the Utility Models described above, have clearly revealed a series of advantages, above all those which already exist, but also a series of drawbacks which the present model aims to put right; on the one hand, the excessive price of the hinge as it was originally conceived, being two open circular longitudinal sections, which had to be specially made and could be not be purchased on the market ready-made, and on the other, a problem of chafing as a result of the hinge working with two circular cross-sections of different diameters, one inside the other, and therefore with a great deal of chafing surface between them, which, as a result of the weight of the door on one of the sections, mounted on the other, brought about an excessive amount of friction between both surfaces of the sections and, therefore, an excessive force the user had to apply to the door in order to move it.

SUMMARY OF THE INVENTION

In the present invention the hinge claimed in Utility Models no. 8903041(9) and no. 9001889(5) has been noticeably simplified, in the sense that the exterior section of the hinge has been eliminated and the pivotal and swivel points of the door on which the present hinge is mounted have been modified, which means that time is saved on mounting as well as on the drawbacks described above, the price of installing the hinge is reduced by half, firstly because materials have been eliminated, and secondly because its mounting and fixing to the already-existing door frames is easier to perform.

Other details and features of the current application for a Patent of Invention, will become clear during the description which follows, where reference is made to the drawings that accompany this Specification which provides, in a somewhat schematic manner, the preferred details. These details are given by way of example, referring to a possible embodiment, but this is not limited to the details which are hereinafter set out, and therefore this description should be seen as designed to illustrate and without any kind of limitations.

The various elements numbered in the drawings attached to the current specification are set out below: (10) door, (11) central part of hinge, (12) end of hinge (11), (13) screws, (14) stub, (15) door frame (10), (16) lintel, (17) jamb, (18) longitudinal groove, (19) supporting post, (20) angular support, (21) central part of lower hinge, (22) end of hinge, (23) conical surface of (21), (25) circular section, (26) plate, (27) cavity, (28) drill, (29) pin, (30) spring.

DESCRIPTION OF THE PREFERRED EMBODIMENT

Figure 1:
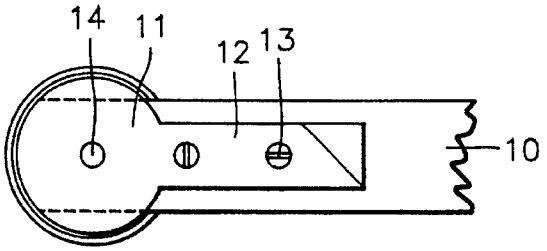
FIG. 1 is a section of the view in plan of the door (10) to which the hinge has been fixed (11–12), becoming secured to the upper part of the door by the screws (13).
Figure 3:
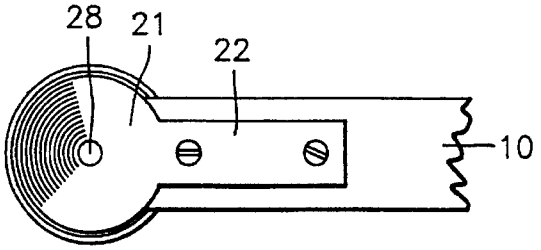
FIG. 3, is a section of the view in plan of the lower part of the door (10) as well as the lower hinge (21–22).
Figure 2:
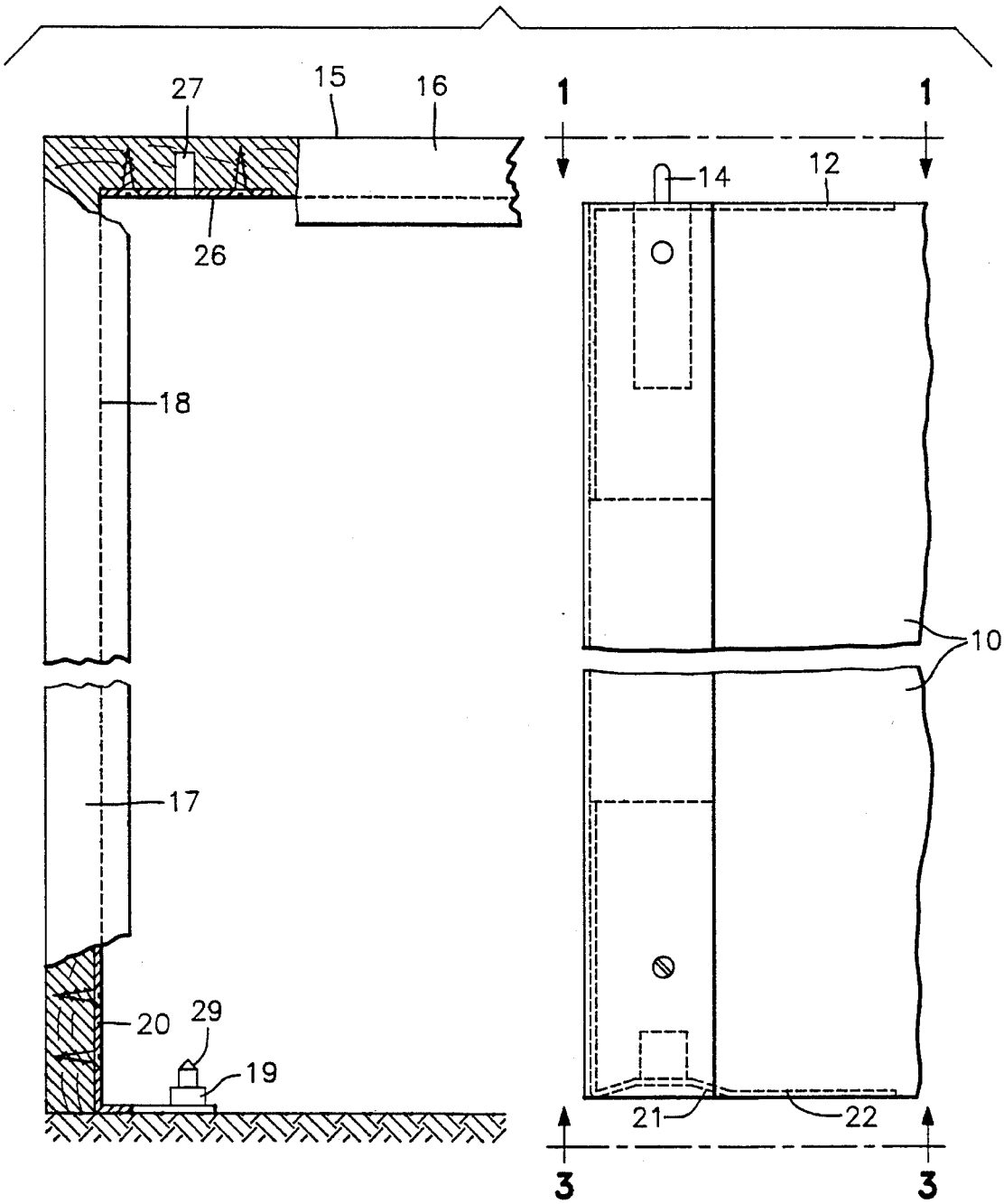
FIG. 2 is a frontal axonometric view of a door (10) frame (15) the plate (26) being mounted on the lintel (16) and the support (20) on (15).
Figure 4:
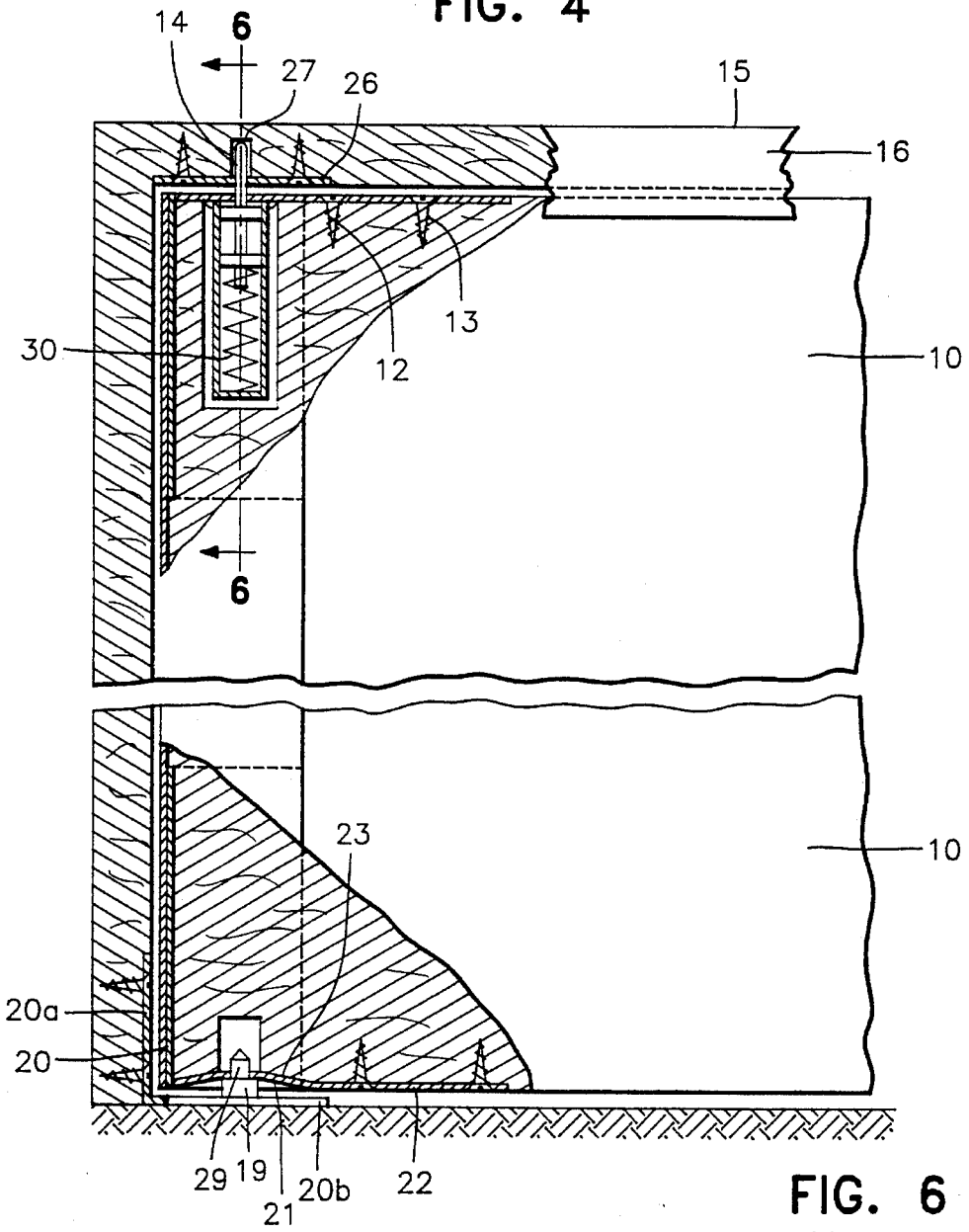
FIG. 4, is a section of the frontal axonometric view of the door (10), to which the hinges have been mounted (21–22) and (11–12).
Figure 5:
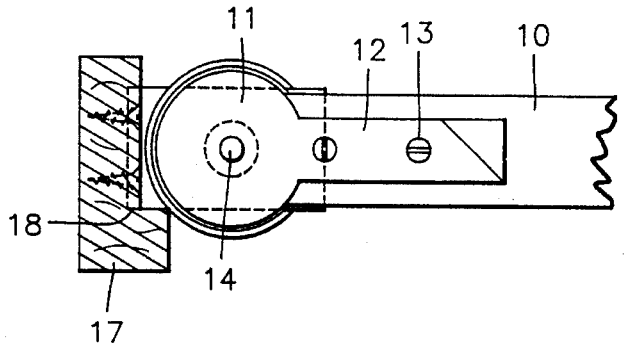
FIG. 5, is a section of the view in plan of the door (10) mounted onto the jamb (17) through section (25).

In one of the preferred embodiments of what is the object of the current application, and as can be seen from the figures attached, the perfected hinge is formed by a circular section (25) which covers one of the vertical edges of the door (10) and which in turn covers the top and bottom of the hinge (11–12) secured to the upper part of the door (10), as well as to the hinge (21–22) secured to the lower part of (10).

The hinge (11–12) is formed by a door plate having circular portion (11) which extends into a rectangular portion (12), which acts as a securing element to the door (10) and to one of its minor horizontal upper edges, by the screws (13).

The hinge (21–22), which is also formed by a circular part or plate (21), is mounted on the lower part of the door (10) and extends into a rectangular area (22) which, the same as (12), serves to secure it to the lower horizontal base of the door (10).

The circular section (25) covers the whole of the vertical edge of the door (10), as well as the hinges (11–12) and (21–22), being mounted to the door frame (15) formed by the lintel (16) and the jambs (17) via an angular support (20) and a plate (26).

A stub (14) emerges in the central part of (11), equipped with the corresponding spring which is fitted into the cavity (27) of the plate (26), allowing easy fitting of the door to the frame (15) as well as its removal if necessary, all this is assisted by a slightly conical configuration of the lower hinge (21–22) formed by the surface (23) equipped with a drilled hole (28) into which the semiaxis (29) is introduced.

Figure 6:
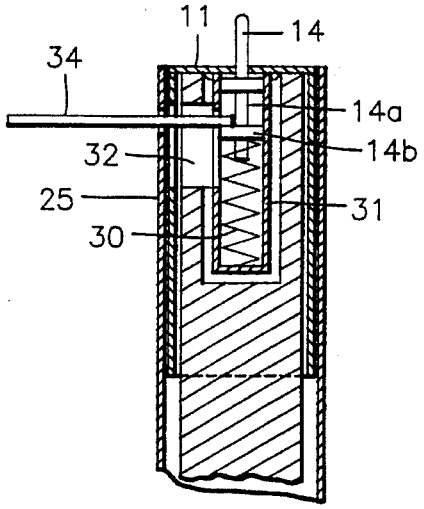
FIG. 6, is a cross-section of the axonometric of the door (10) with the hinge (11–12) mounted on its upper part.

As seen in FIG. 6, stub 14 has an internal portion 14*a* with a collar 14*b* which fits in a barrel 31 received in the door with spring 30 pressing against collar 14*b*. An aperture 32 in the door leads into the barrel and provides access to the stub for a rod 34. The rod can be used to depress the stub and allow the door to be removed from the frame.

On the lower part of the door frame (15) there is a supporting post (19) which is formed by an angular support (20) and a pin (29), the mounting of this support (20) means that it is not necessary to make holes in the floor, which in some cases brings about breakage of the ceramic tiles, parquet or the like which are fixed onto it. The support (20) has a vertical plate (20*a*) secured to the door jamb and a horizontal plate (20*b*) resting on the floor.

With this new embodiment the previous versions which were the object of Utility Models no. 8903041(9) and no. 9001889(5) have been simplified, in the sense that one of the circular sections which previously covered (25) in this new version has been eliminated and, it is the one which served to secure it to the door frame (15), but which brought about excessive chafing.

After the drawings have been observed and following the explanation we have given about them, it will be seen that the application for a Patent of Invention which is the motive for the present specification, provides a simple and effective construction which may be put into practice with great ease, constituting, without any doubt, a new industrial result.

It is stated, for whichever purposes may be deemed necessary, that all those variations and modifications in detail which circumstances and practice might bring about may be introduced in the object which makes up the current application for a Patent of Invention, provided that the essential quality which is summarised in the following CLAIMS does not alter or become modified with the variations which are introduced.

I claim:

1. A hinge structure for pivotally mounting a door in a door frame, the door frame comprising a vertical door jamb rising from a floor and an overhead lintel, the door having a part-circular vertical edge portion, the hinge structure comprising a sprung stub extending outwardly from said vertical edge portion at a top edge of the door, a lower door plate with an aperture therein along a bottom edge of the door, said aperture located at said vertical edge portion of the door, an angular support for the door comprising a vertical plate with attachment means for securing the vertical plate to the door jamb and a horizontal plate to rest on the floor, a support post on the horizontal plate and a pin extending from the post for receipt in said aperture in the lower door plate, said stub being adapted to be received in a cavity in the lintel.

2. A hinge structure as claimed in claim 1 wherein the lower door plate comprises a rectangular portion secured along the bottom edge of the door and a circular portion at one end of the rectangular portion, the circular portion covering said vertical edge portion of the door and having said aperture centrally located therein.

3. A hinge structure as claimed in claim 2 wherein said circular portion of the lower door plate is conically shaped in cross section and recessed into the door.

4. A hinge structure as claimed in claim 1 which includes an upper door plate having a rectangular portion secured along the top edge of the door and a circular portion at one end of the rectangular portion, the circular portion covering said vertical edge portion of the door and having a central aperture through which said stub is projected.

5. A hinge structure as claimed in claim 1 wherein said stub has an internal portion with a collar received in a barrel located in said vertical edge portion of the door, the structure further including a coil spring received in the barrel and pressing against said collar to urge the stub outwardly and an access aperture in the door leading into said barrel for insertion of a rod to engage said collar and depress the stub against the action of the spring for releasing the door from the door frame.

* * * * *